US008463147B2

(12) United States Patent
Fuchimoto

(10) Patent No.: US 8,463,147 B2
(45) Date of Patent: Jun. 11, 2013

(54) IMAGE FORMING APPARATUS, METHOD FOR FORMING IMAGE, AND COMPUTER-READABLE RECORDING MEDIUM

(75) Inventor: Nobuyuki Fuchimoto, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 278 days.

(21) Appl. No.: 12/975,514

(22) Filed: Dec. 22, 2010

(65) Prior Publication Data

US 2011/0158670 A1 Jun. 30, 2011

(30) Foreign Application Priority Data

Dec. 28, 2009 (JP) ..... 2009-297280

(51) Int. Cl.
*G03G 15/00* (2006.01)

(52) U.S. Cl.
USPC ..... 399/49; 399/72

(58) Field of Classification Search
USPC ..... 399/49, 55, 72
See application file for complete search history.

(56) References Cited

U.S. PATENT DOCUMENTS

| | | | | |
|---|---|---|---|---|
| 5,305,057 | A * | 4/1994 | Hattori et al. | 358/519 |
| 5,504,557 | A * | 4/1996 | Morita | 399/56 |
| 2007/0116483 | A1* | 5/2007 | Kobayashi et al. | 399/49 |
| 2008/0138100 | A1* | 6/2008 | Matsuyama | 399/53 |

FOREIGN PATENT DOCUMENTS

| | | | |
|---|---|---|---|
| JP | 2002-296851 | | 10/2002 |
| JP | 2005331658 | A * | 12/2005 |

OTHER PUBLICATIONS

Machine translation of Hikosaka, JP 2005-331658.*

* cited by examiner

*Primary Examiner* — David Gray
*Assistant Examiner* — Sevan A Aydin
(74) *Attorney, Agent, or Firm* — K&L Gates LLP

(57) ABSTRACT

An image forming apparatus includes an image bearing member bearing an image; a transfer member having the image transferred thereto from the image bearing member; a correction-image-formation control unit that causes, on the transfer member, a bias correction image to be formed based on an uncorrected bias and a first parameter-correction image to be formed immediately behind the bias correction image based on the uncorrected bias and an uncorrected image-formation parameter; a bias correcting unit obtaining a corrected bias by correcting the uncorrected bias based on the bias correction image; a bias determining unit for determining whether the corrected bias is within a predetermined range defined based on the uncorrected bias; and a parameter correcting unit obtaining, if the corrected bias is within the predetermined range, a corrected image-formation parameter by correcting the uncorrected image-formation parameter based on the first parameter-correction image.

8 Claims, 8 Drawing Sheets

Prior Art

IMAGE FORMING APPARATUS, METHOD FOR FORMING IMAGE, AND COMPUTER-READABLE RECORDING MEDIUM

INCORPORATION BY REFERENCE

This application is based upon and claims the benefit of priority from the corresponding Japanese Patent application No. 2009-297280, filed Dec. 28, 2009, the entire contents of which is incorporated herein by reference.

BACKGROUND

The present invention relates to image forming apparatuses, methods for forming an image, and computer-readable recording media. In particular, the present invention relates to techniques for reducing the time required for the entire calibration process.

In an image forming apparatus, such as a color printer or a color multifunction peripheral, the electrical and mechanical conditions that are required for image forming and output operations (color printing) are modified in accordance with changes in the environment where the image forming apparatus is used, the level of wear and tear on the components, the number of printing operations, etc. For example, when color printing based on the same image data is performed on different days, the color and density of an image on the first printed sheet may be different from the image on the second printed sheet, due to changes in the electrical and mechanical conditions described above.

As a solution to this issue, an image forming apparatus with color printing capability performs a calibration that involves correcting color or density for to resolve the problem of color change or density reduction in printed images (output images). Execution of such a calibration makes it possible for the output images on the first and second printed sheets to have consistent image quality.

There are several types of calibrations, including bias calibration, I/O calibration, and registration calibration. Bias calibration corrects a bias (developing bias) applied to a developing device (developing roller) in accordance with the density of a test image (which may hereinafter be referred to as a correction image or a patch). I/O calibration corrects a color density gradient (which may hereinafter be referred to as a γ table) used to correct the color density of an actually formed image (output density) relative to the density of a predetermined color in image data (input density). Registration calibration measures the position of a patch formed in a predetermined shape and corrects misregistration of the patch. For example, predetermined types of calibrations are performed depending on the specifications, settings, or usage of the image forming apparatus.

Conventionally, these three types of calibrations; i.e., bias calibration, I/O calibration, and registration calibration have been performed sequentially at a predetermined time, such as when the image forming apparatus is turned on or when a predetermined number of printed sheets have been outputted.

A series of calibrations that are conventionally performed will now be described.

FIG. 8 illustrates an example of patch patterns that are used in a series of calibrations in the prior art. The different sections illustrated in FIG. 8 correspond to respective three turns of an intermediate transfer belt B1.

In a series of calibrations that are conventionally performed, first, a bias is corrected by executing a bias calibration. Then, an I/O calibration and registration calibration are performed using the corrected bias.

That is, in the series of calibrations, as illustrated in FIG. 8, in section 801 for the first turn of the intermediate transfer belt B1, a background density at a position for forming a patch pattern (a predetermined number of patches) 800*a* for bias calibration and a background density at a position for forming a patch pattern 800*b* for I/O calibration are calculated (measured) using two density sensors 802 and 803, respectively.

Next, in section 804 for the second turn of the intermediate transfer belt B1, the patch pattern 800*a* for bias calibration is formed using a predetermined bias, at a position corresponding to the position at which the background density was measured. Then, the predetermined bias is corrected based on the density (measured density) of the patch pattern 800*a* and the density (target density) for forming the patch pattern 800*a*.

Next, in section 805 for the third turn of the intermediate transfer belt B1, the patch pattern 800*b* for I/O calibration and a patch pattern 800*c* for registration calibration are sequentially formed at predetermined positions using the corrected bias. Then, a γ table and misalignment are corrected using the patch pattern 800*b* and the patch pattern 800*c*, respectively.

However, in the series of calibrations in the prior art, as illustrated in FIG. 8, the bias calibration needs to be completed before execution of the I/O calibration and registration calibration that require a corrected bias. To complete the bias calibration, it is necessary that a patch at the trailing end of the patch pattern 800*a* (in the running direction of the intermediate transfer belt B1) reaches a predetermined detectable range of the density sensor 802 so that its density can be detected. Therefore, during the period from formation of the patch pattern 800*a* for the bias calibration on the intermediate transfer belt B1 until detection of the density of the patch at the trailing end of the patch pattern 800*a*, it is not possible to form, on the intermediate transfer belt B1, the patch pattern 800*b* for I/O calibration and the patch pattern 800*c* for registration calibration.

As a result, on the intermediate transfer belt B1, an empty space 806, where no patch pattern is formed, is created immediately behind the patch pattern 800*a*, as illustrated in FIG. 8. This means that the time required for the series of calibrations (i.e., the entire calibration process) increases by the amount of time that corresponds to the empty space 806.

The bias that influences the color or density of the image on a printed sheet changes depending on predetermined factors, such as temperature and humidity within the image forming apparatus. However, when bias calibration is frequently performed, even if a bias is corrected in the bias calibration, there may be no significant difference between the uncorrected bias and the corrected bias. For example, when the image forming apparatus is repeatedly turned on and off in a short period of time for maintenance operation, a bias in the previous bias calibration and the most recent bias calibration are substantially the same. In such a situation, it will not be necessary to wait for the result of bias correction in bias calibration before forming the patch pattern 800*b* for I/O calibration and the patch pattern 800*c* for registration calibration.

In recent years, a predetermined number of parameters that influence changes in bias have been discovered. This means that by determining these parameters, it is becoming possible to estimate (determine) a variation in bias under conditions of the determined parameters, based on the previously calculated relationships between bias and the predetermined number of parameters. In other words, that a difference between a bias estimated from past data (estimated value) and a bias obtained by bias calibration actually executed (measured value) is decreasing. If a corrected bias can be accurately estimated from past data and a predetermined number of parameters, there is no problem in forming the patch pattern 800*b* for I/O calibration and the patch pattern 800*c* for registration calibration using the estimated bias, without waiting for the result of bias correction in bias calibration. The time required for the entire calibration process can thus be reduced, which was not achievable in the prior art.

SUMMARY

An image forming apparatus according to an embodiment of the present disclosure includes an image bearing member, a transfer member, a correction-image-formation control unit, a bias correcting unit, a bias determining unit, and a parameter correcting unit. The image bearing member bears an image. The transfer member is a member to which the image is transferred from the image bearing member. The correction-image-formation control unit performs control such that, on the transfer member, a bias correction image is formed based on an uncorrected bias and a first parameter-correction image is formed immediately behind the bias correction image based on the uncorrected bias and an uncorrected image-formation parameter. The bias correcting unit obtains a corrected bias by correcting the uncorrected bias based on the bias correction image. The bias determining unit determines whether the corrected bias is within a predetermined range defined on the basis of the uncorrected bias. The parameter correcting unit obtains, if the corrected bias is within the predetermined range, a corrected image-formation parameter by correcting the uncorrected image-formation parameter based on the first parameter-correction image.

A method for forming an image according to another embodiment of the present disclosure includes controlling the formation of a first parameter-correction image, obtaining a corrected bias, determining, and obtaining a corrected image-formation parameter. The controlling the formation step that forms the first parameter-correction image, controls the process such that, on a transfer member to which an image is transferred from an image bearing member bearing the image, a bias correction image is formed based on an uncorrected bias and the first parameter-correction image is formed immediately behind the bias correction image based on the uncorrected bias and an uncorrected image-formation parameter. The obtaining the corrected bias step obtains the corrected bias by correcting the uncorrected bias using the bias correction image. The determining step determines whether the corrected bias is within a predetermined range that is defined based on the uncorrected bias. The obtaining the corrected image-formation parameter step obtains, if the corrected bias is within the predetermined range, the corrected image-formation parameter by correcting the uncorrected image-formation parameter using the first parameter-correction image.

A computer-readable recording medium according to another embodiment of the present disclosure records a program for having a computer function as the correction-image-formation control unit, the bias correcting unit, the bias determining unit, and the parameter correcting unit.

Additional features and advantages are described herein, and will be apparent from the following Detailed Description and the figures.

BRIEF DESCRIPTION OF THE FIGURES

The following description, given by way of example, but not intended to limit the disclosure solely to the specific embodiments described, may best be understood in conjunction with the accompanying drawings, in which.

DETAILED DESCRIPTION

Reference will now be made in detail to various embodiments of the disclosure, one or more examples of which are illustrated in the accompanying drawings. Each example is provided by way of explanation of the disclosure, and not limitation. In fact, it will be apparent to those skilled in the art that various modifications, combinations, additions, deletions and variations can be made in the present disclosure without departing from the scope or spirit of the present disclosure. For instance, features illustrated or described as part of one embodiment can be used in another embodiment to yield a still further embodiment. It is intended that the present disclosure covers such modifications, combinations, additions, deletions, applications and variations that come within the scope of the appended claims and their equivalents. Embodiments of image forming apparatus, image forming method, and computer-readable recording medium will now be described in detail.

For a better understanding of the present disclosure, embodiments of an image forming apparatus according to the present disclosure will now be described with reference to the attached drawings. Note that the following embodiments are merely examples of the present disclosure and are not intended to limit the technical scope of the present disclosure. In the flowchart set forth in FIG. 5, to be described below, the letter "S" preceding each number represents a step in the process.

An embodiment of an image forming apparatus 1 will now be described.

Figure 1:
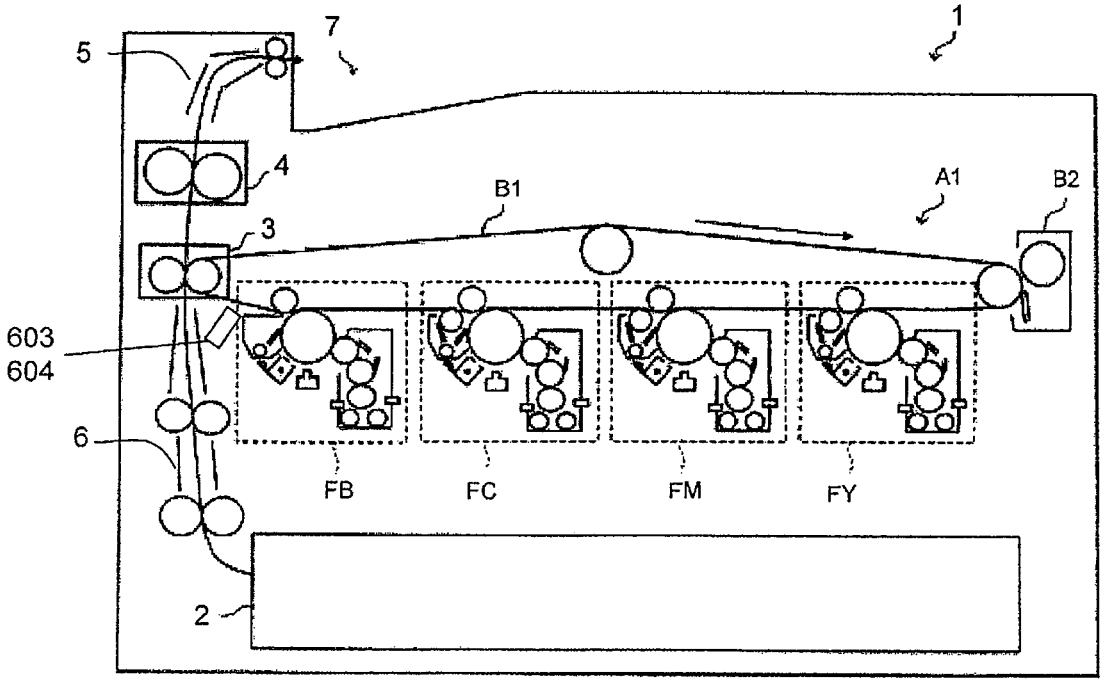
FIG. 1 is a schematic view of an image forming apparatus according to an embodiment of the present disclosure.

FIG. 1 is a schematic view of the image forming apparatus 1 according to the present embodiment.

The image forming apparatus 1 is, for example, a multi-function peripheral, a copier, or a printer. The image forming apparatus 1 includes a tandem-type image forming assembly A1 that forms toner images based on image data, a sheet container 2 that stores sheets, and a secondary transfer unit 3 that transfers a toner image formed by the image forming assembly A1 to a sheet. The image forming apparatus 1 also includes a fixing unit 4 that fixes a transferred toner image to a sheet, an ejecting device 5 that ejects a sheet having a fixed toner image thereon, and an output tray 7 that holds ejected sheets. The image forming apparatus 1 further includes a sheet conveying unit 6 that conveys sheets from the sheet container 2 to the ejecting device 5.

The image forming assembly A1 includes an intermediate transfer belt B1 (transfer member), a cleaning unit B2 for cleaning the intermediate transfer belt B1, and image forming units FY, FM, FC, and FB corresponding to yellow (Y), magenta (M), cyan (C), and black (B) colors, respectively.

The intermediate transfer belt B1 is electrically conductive. The intermediate transfer belt B1 is an endless or looped belt-like member and its width perpendicular to the sheet conveying direction is greater than that of the widest sheet. The intermediate transfer belt B1 is driven so as to run in a clockwise direction in FIG. 1.

In the running direction of the intermediate transfer belt B1, the image forming units FY, FM, FC, and FB are located in this order along the intermediate transfer belt B1, located downstream of the cleaning unit B2, and located upstream of the secondary transfer unit 3. The position of the image forming units FY, FM, FC, and FB is not limited to this, but this arrangement is preferable due to the effect of color mixing on the resulting image. The image forming units FY, FM, FC, and FB are evenly spaced.

Figure 2:
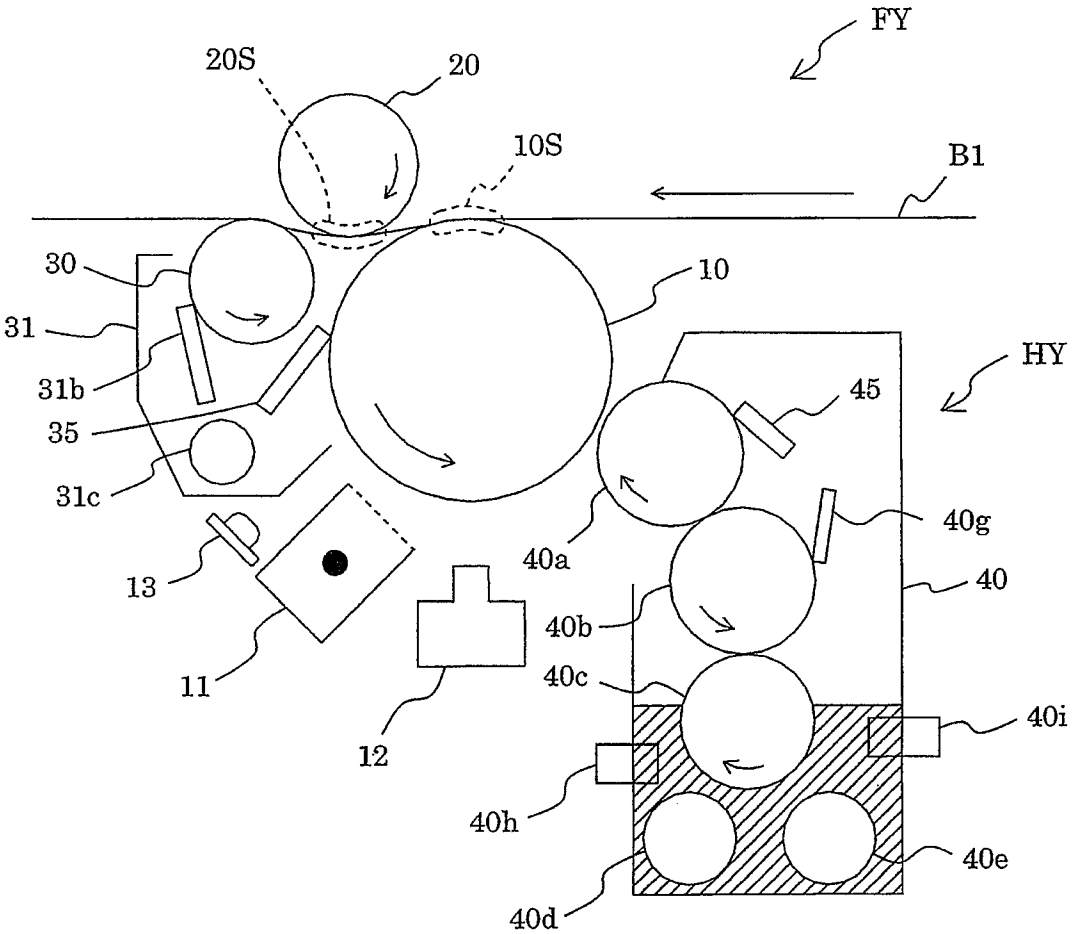
FIG. 2 illustrates an image forming unit included in the image forming apparatus of FIG. 1.

An image forming operation of the image forming apparatus 1 will now be described using the image forming unit FY as an example. FIG. 2 is a detailed illustration of one of the image forming units FY, FM, FC, and FB, which have substantially the same configuration.

The image forming unit FY includes a photosensitive drum 10, a charger 11, an exposure device 12, a developing unit HY for yellow, a primary transfer roller 20, a cleaning blade 35 for the photosensitive drum 10, a charge eliminating device 13, and a carrier removing roller 30.

Instead of the developing unit HY described above, the other image forming units FM, FC, and FB include developing units HM, HC, and HB, respectively, for their corresponding colors. Of the image forming units FY, FM, FC, and FB, the image forming unit FB located at the most downstream position, in the running direction of the intermediate transfer belt B1, does not include the carrier removing roller 30, as there is no image forming unit downstream of the image forming unit FB. Except for this difference, the image forming units FY, FM, FC, and FB have the same configuration.

The photosensitive drum 10 may have any design as long as it can carry a toner image containing charged toner particles (positively charged, in the present embodiment) on its surface.

In the present embodiment, the photosensitive drum 10 is substantially cylindrical in shape. The photosensitive drum 10 is rotatable about a rotation axis that is perpendicular to the running direction of the intermediate transfer belt B1 and parallel to the width direction of the intermediate transfer belt B1. The photosensitive drum 10 is in contact with the surface of the intermediate transfer belt B1 at a predetermined primary transfer position 10S. At the primary transfer position 10S, the photosensitive drum 10 is rotatable in the running direction of the intermediate transfer belt B1. In other words, the photosensitive drum 10 rotates counterclockwise in FIG. 2.

The cleaning blade 35, the charge eliminating device 13, the charger 11, the exposure device 12, and the developing unit HY are arranged in this order, as viewed from the primary transfer position 10S, around the photosensitive drum 10 in the rotation direction of the photosensitive drum 10.

The charger 11 is capable of uniformly charging the surface of the photosensitive drum 10. The exposure device 12 has a light source, such as a light-emitting diode (LED). In accordance with image data from a higher-level device, such as a personal computer (PC), the exposure device 12 irradiates the charged surface of the photosensitive drum 10 with light corresponding to the image data, and thereby forms an electrostatic latent image on the surface of the photosensitive drum 10.

The developing unit HY holds developer containing yellow toner and liquid carrier such that the developer faces the electrostatic latent image. The developing unit HY applies the toner to the electrostatic latent image, and develops the electrostatic latent image as a toner image. This toner image is primary-transferred by the primary transfer roller 20 to the intermediate transfer belt B1. The primary transfer roller 20 will be described in detail below.

The cleaning blade 35 is a blade-like member that is in contact with the photosensitive drum 10. After the primary transfer, the cleaning blade 35 removes residual developer from the surface of the photosensitive drum 10.

The charge eliminating device 13 has a light source. After the residual developer is removed by the cleaning blade 35, the charge eliminating device 13 eliminates the charge from the surface of the photosensitive drum 10 using light from the light source, and prepares for the next image formation.

The primary transfer roller 20 is located such that it is in contact with the outer surface of the intermediate transfer belt B1 at a voltage application position 20S. The voltage application position 20S is located downstream of the primary transfer position 10S, in the running direction of the intermediate transfer belt B1. A voltage having a polarity (negative polarity, in the present embodiment) that is opposite that of toner in the toner image is applied from a power supply (not shown) to the primary transfer roller 20. That is, at the voltage application position 20S, a voltage having a polarity that is opposite that of toner can be applied by the primary transfer roller 20 to the intermediate transfer belt B1. Since the intermediate transfer belt B1 is electrically conductive, the application of voltage causes the toner to be attracted to the surface of the intermediate transfer belt B1 at and around the voltage application position 20S.

Therefore, in the present embodiment, the primary transfer position 10S is set to be within a range that allows toner to be attracted to the intermediate transfer belt B1 due to the voltage. Thus, in the primary transfer, the toner is transferred from the photosensitive drum 10 to the surface of the intermediate transfer belt B1.

As long as the primary transfer described above is possible, the configuration of the primary transfer roller 20 is not limited to a specific one and may be changed where appropriate. In the present embodiment, the primary transfer roller 20 is a substantially columnar member that is rotatable about a rotation axis parallel to that of the photosensitive drum 10. The primary transfer roller 20 rotates in a direction opposite to the rotation direction of the photosensitive drum 10. That is, the primary transfer roller 20 is rotatable such that the direction of its movement at the voltage application position 20S is the same as the running direction of the intermediate transfer belt B1.

In the present embodiment, the carrier removing roller 30 is a substantially columnar member rotatable about a rotation axis parallel to that of the photosensitive drum 10, in the same direction as the rotation direction of the photosensitive drum 10. However, the configuration of the carrier removing roller 30 is not limited to this. The carrier removing roller 30 may have any configuration as long as it is located downstream of the voltage application position 20S and upstream of a secondary transfer position in the running direction of the intermediate transfer belt B1, and it can remove carrier from the surface of the intermediate transfer belt B1. Specifically, the carrier removing roller 30 can have any configuration as long as it can be in contact with the surface of the intermediate transfer belt B1 and allow the carrier on the surface of the intermediate transfer belt B1 to be transferred to its own surface.

During primary transfer, a small amount of carrier may be transferred from the photosensitive drum 10 to the intermediate transfer belt B1 together with toner. This transfer of carrier can interfere with primary transfer in image forming units on the downstream side and cause image defects, such as image blurring. With the carrier removing roller 30, such image defects can be prevented.

In the present embodiment, the carrier removing roller 30 is in contact with the surface of the intermediate transfer belt B1 at a position downstream of the voltage application position 20S, in the running direction of the intermediate transfer belt B1. The carrier removing roller 30 is included in a cleaning unit 31, together with the cleaning blade 35. The cleaning unit 31 is positioned inside the image forming unit FY and includes a carrier removing blade 31*b* and a conveying member 31*c*, as well as the cleaning blade 35 and the carrier removing roller 30. The carrier removing blade 31*b* is in contact with the surface of the carrier removing roller 30 and removes carrier adhering to the surface of the carrier removing roller 30. The conveying member 31*c* moves carrier removed from the carrier removing roller 30 and developer (containing toner and carrier) removed from the surface of the photosensitive drum 10 by the cleaning blade 35, outside of the cleaning unit 31. For recycling of the toner and carrier removed by the conveying member 31*c*, the image forming unit FY may include a separating unit that separates carrier from toner.

A configuration of the developing unit HY will now be described. The developing units HY, HM, HC, and HB for the respective colors have the same configuration.

The developing unit HY includes a developer container 40, a developing roller 40*a*, a supply roller 40*b*, a drawing-up roller 40*c*, agitating spirals 40*d* and 40*e*, a cleaning blade 45, and a supply-roller doctor blade 40*g*.

The developer container 40 stores developer containing yellow toner particles and liquid carrier. The agitating spirals 40*d* and 40*e* are fully immersed in the developer stored in the developer container 40 and agitate the developer. Rotation of the agitating spirals 40*d* and 40*e* causes the toner particles to be uniformly distributed in the carrier liquid.

The drawing-up roller 40*c* is partially immersed in the developer stored in the developer container 40. The drawing-up roller 40*c* allows the developer to adhere to its surface, and thereby draws up the developer. The supply roller 40*b* is in contact with the drawing-up roller 40*c*, which supplies the developer to the supply roller 40*b*. The supply-roller doctor blade 40*g* is located downstream of a position at which the supply roller 40*b* is in contact with the drawing-up roller 40*c*, in the rotation direction of the supply roller 40*b*. The supply-roller doctor blade 40*g* regulates, to a predetermined level, the thickness of a layer of the developer on the surface of the supply roller 40*b*. The developing roller 40*a* (also referred to as a developing device) is in contact with the supply roller 40*b*, which supplies the developer to the surface of the developing roller 40*a*. Since the thickness of the developer layer on the supply roller 40*b* is regulated to a predetermined level, the thickness of a layer of the developer formed on the surface of the developing roller 40*a* can also be regulated to a predetermined level. The developing roller 40*a* is in contact with the photosensitive drum 10. Due to a potential difference between the potential of the electrostatic latent image on the surface of the photosensitive drum 10 and a developing bias applied to the developing roller 40*a*, a toner image corresponding to an image forming instruction from a higher-level device is formed on the surface of the photosensitive drum 10 (developing operation).

The image forming apparatus 1 corrects the density of the toner image by adjusting the developing bias (i.e., a voltage, simply referred to as a bias) applied to the developing roller 40*a*.

After completion of the developing operation on the photosensitive drum 10, the developer on the surface of the developing roller 40*a* is removed by the cleaning blade 45, flows downward along the surface of the cleaning blade 45, passes through a flow path (not shown), and mixes with the developer stored in the developer container 40.

The developer container 40 is provided with a toner concentration sensor 40*h* that detects the concentration of the toner in the developer that is stored in the developer container 40. If the toner concentration sensor 40*h* detects that the toner concentration is less than a predetermined value, toner (i.e., developer in which the toner concentration is greater than the predetermined value) is supplied from a toner cartridge (not shown) to the developer container 40. If the toner concentration sensor 40*h* detects that the toner concentration is greater than the predetermined value, carrier liquid is supplied from a carrier liquid cartridge (not shown) to the developer container 40.

Also, the developer container 40 is provided with a developer liquid-level sensor 40*i* that detects whether the liquid level of developer in the developer container 40 is at a predetermined value. If the developer liquid-level sensor 40*i* detects that the liquid level of the developer is less than the predetermined value, toner in the toner cartridge (not shown) and carrier liquid in the carrier liquid cartridge (not shown) are supplied through pipes (not shown) to the developer container 40 at a predetermined ratio, and the liquid level of the developer is adjusted to the predetermined value. There may be provided a developer adjusting device that mixes toner with carrier liquid at a predetermined ratio and supplies them to the developer container 40. If the developer liquid-level sensor 40*i* detects that the level of the developer is greater than the predetermined value, the developer is discharged through a developer discharge pipe (not shown) of the developer container 40 and temporarily stored in a reserve tank (not shown).

With this configuration, upon receipt of an image forming instruction from a higher-level device, the image forming apparatus 1 forms toner images of the respective colors using the image forming units FY, FM, FC, and FB. The toner images formed by the respective image forming units FY, FM, FC, and FB are transferred to the intermediate transfer belt B1, superimposed on one another on the intermediate transfer belt B1, and formed into a color toner image.

In synchronization with the formation of the color toner image, sheets stored in the sheet container 2 are removed, one by one, from the sheet container 2 by a feeder (not shown), and fed on the sheet conveying unit 6. In synchronization with primary transfer to the intermediate transfer belt B1, each sheet is fed into the secondary transfer unit 3, where the color toner image on the intermediate transfer belt B1 is secondary-transferred to the sheet. The sheet having the color toner image thereon is then fed to the fixing unit 4, where the color toner image is fixed to the sheet by heat and pressure. Then, the sheet is ejected by the ejecting device 5 to the output tray 7 on the periphery of the image forming apparatus 1. After the second transfer, residual toner on the intermediate transfer belt B1 is removed therefrom by the cleaning unit B2.

Two density sensors 603 and 604 detect the densities of patches formed on the intermediate transfer belt B1 and background densities of the intermediate transfer belt B1 at predetermined times. The density sensors 603 and 604 are located at predetermined positions between the secondary transfer unit 3 and the image forming unit FB for black, which is located downstream of the other image forming units FY, FM, and FC in the running direction of the intermediate transfer belt B1. The density sensors 603 and 604 are designed to detect densities of patches formed by any of the image forming units FY, FM, FC, and FB on the intermediate transfer belt B1. The density sensors 603 and 604 are provided in advance at positions corresponding to respective areas on the intermediate transfer belt B1 where patches are formed. In the embodiment, the density sensors 603 and 604 are located near respective edges of the intermediate transfer belt B1. The density sensors 603 and 604 can have any design as long as they are capable of detecting the densities of patches of each color or the background densities. For example, the density sensors 603 and 604 each can be a reflection-type sensor that irradiates patches or the background of the intermediate transfer belt B1 with light from a light source, detects the intensity of reflected light with a photoreceptor, and converts the light intensity information to densities.

Figure 3:
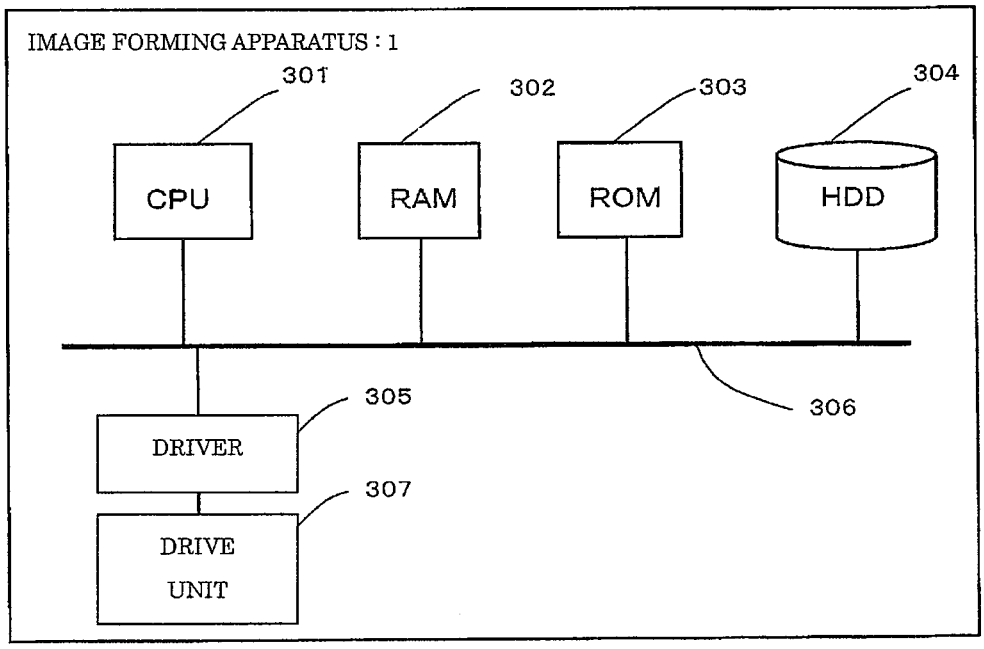
FIG. 3 is a schematic diagram illustrating control system hardware of the image forming apparatus of FIG. 1.

FIG. 3 is a schematic diagram illustrating a control-related configuration of the image forming apparatus 1 according to the present embodiment.

The image forming apparatus 1 include a central processing unit (CPU) 301, a random-access memory (RAM) 302, a read-only memory (ROM) 303, a hard disk drive (HDD) 304, a drive unit 307 for printing, and a driver 305 corresponding to the drive unit 307. As illustrated in FIG. 3, the CPU 301, the RAM 302, the ROM 303, the HDD 304, and the driver 305 in the image forming apparatus 1 are connected via an internal bus 306. For example, the CPU 301 uses the RAM 302 as a working area to execute a program stored in the ROM 303 or the HDD 304. Based on the results of this execution, the CPU 301 transmits and receives commands and data to and from the driver 305, thereby controlling the operation of each drive unit illustrated in FIG. 1. Like the drive unit 307, each of the other components described below (see FIG. 4) performs its operation when the CPU 301 executes a program.

Figure 4:
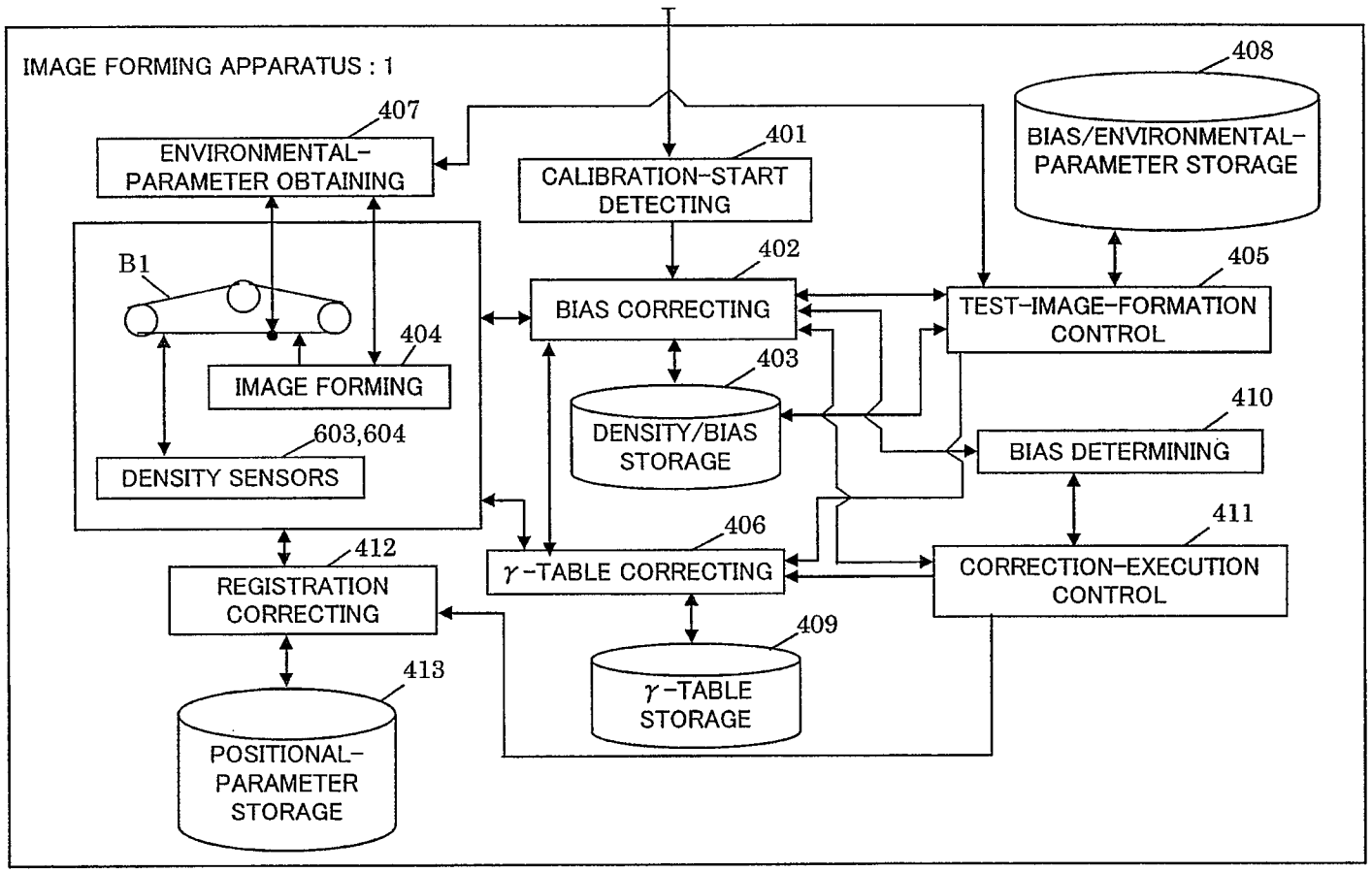
FIG. 4 is a functional block diagram of the image forming apparatus illustrated in FIG. 1.
Figure 5:
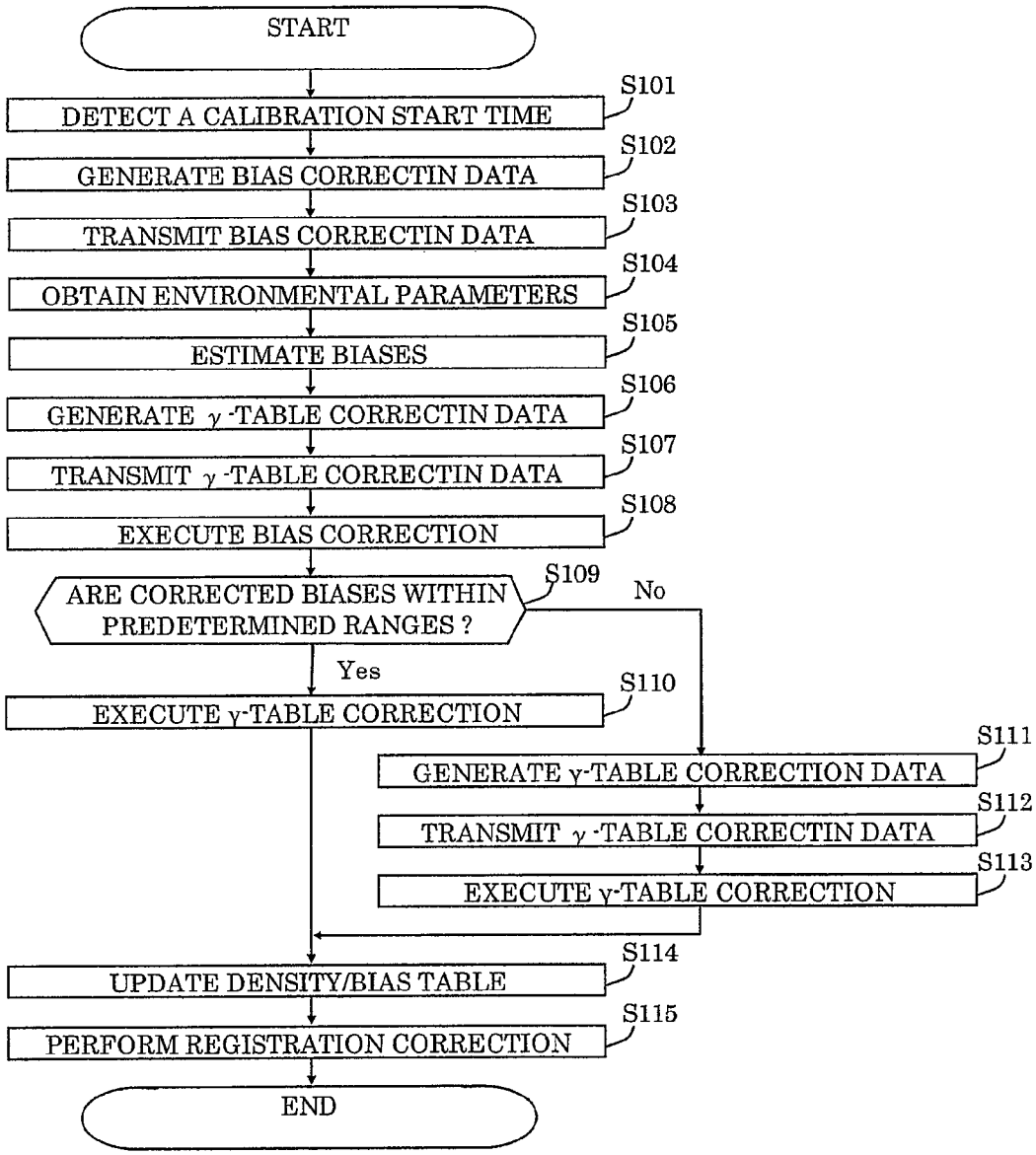
FIG. 5 is a flowchart illustrating an execution procedure according to an embodiment of the present disclosure.

Referring now to FIG. 4 and FIG. 5, a description will be given of a procedure in which the image forming apparatus 1 of the present embodiment reduces the time required for the entire calibration process without degrading the accuracy of the result of calibration executed using corrected biases. FIG. 4 is a functional block diagram of the image forming apparatus 1. FIG. 5 is a flowchart for illustrating an execution procedure for the image forming apparatus 1.

When the user turns on the image forming apparatus 1 to start color printing, a calibration-start detecting unit 401 detects this power-on time as a calibration start time (step S101 of FIG. 5). To execute a series of calibrations (i.e., bias calibration, I/O calibration, and registration calibration), the calibration-start detecting unit 401 notifies a bias correcting unit 402 configured to execute bias calibration (hereinafter referred to as bias correction) that bias correction is to be performed. Upon receipt of the notification, the bias correcting unit 402 starts bias correction.

Bias correction may be started by any method. For example, the following method may be used.

Upon receipt of a notification indicating that bias correction is to be performed, the bias correcting unit 402 refers to a density/bias table stored in a density/bias storage unit 403 to generate bias correction data using the density/bias table (step S102 of FIG. 5).

Here, the density/bias table is a table that associates predetermined densities (%) with predetermined biases (voltages). Generally, high biases are associated with high densities. In the present embodiment, since the image forming units FY, FM, FC, and FB are provided for the respective colors, different density/bias tables are provided for the respective colors. The density/bias table referred to by the bias correcting unit 402 is one that was used by the bias correcting unit 402 in the previous execution of bias correction. The density/bias tables for the respective colors are to be calibrated, because an image forming unit 404 including the image forming units FY, FM, FC, and FB for the respective colors uses them to perform image formation on the basis of image data. Note that although a density/bias table for one color will be described herein, the same applies to density/bias tables for the other colors.

Figure 6A:
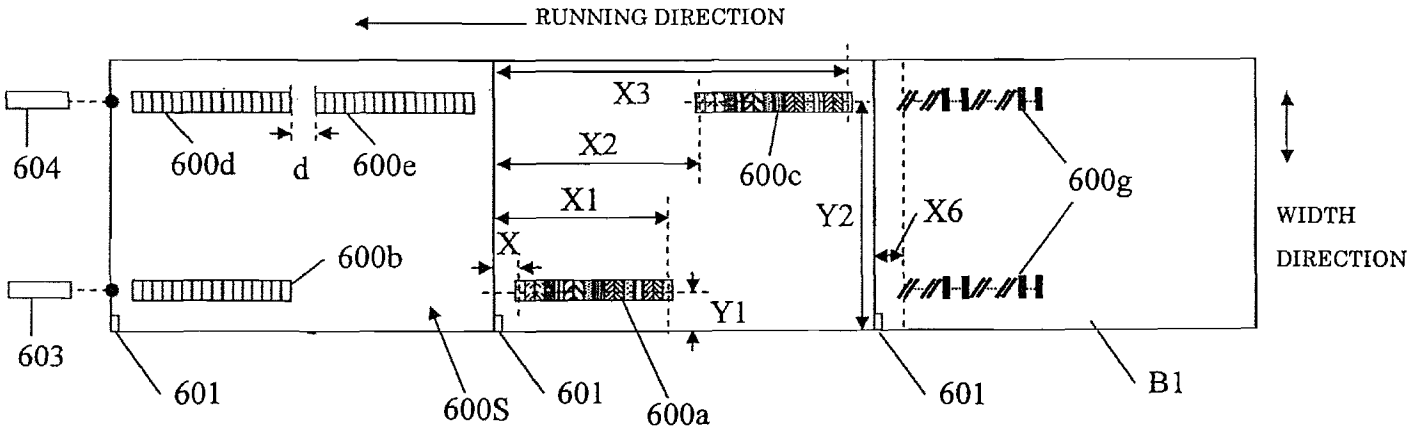
FIG. 6A schematically illustrates patch patterns used when corrected biases are within predetermined ranges in a series of calibrations in an embodiment of the present disclosure.

FIG. 6A schematically illustrates patch patterns used in a series of calibrations in the present embodiment.

The bias correction data described above is data used by the image forming unit 404 to form the bias-correction patch pattern 600*a* illustrated in FIG. 6A. For example, bias correction data includes the following: a predetermined color; predetermined densities (target densities); predetermined biases corresponding to the predetermined color and the predetermined densities and contained in a density/bias table; and positional information for patches to be formed on the intermediate transfer belt B1 based on the predetermined color, the predetermined densities, and the predetermined biases. The positional information is represented, for example, by a coordinate value X relative to a reference piece 601 (see FIG. 6A) provided up front on the intermediate transfer belt B1, in the running direction of the intermediate transfer belt B1 (hereinafter referred to as a running-direction coordinate value), and a coordinate value Y relative to the reference piece 601 in the width direction of the intermediate transfer belt B1 (hereinafter referred to as a width-direction coordinate value). The positional information is determined in accordance with the type of the bias-correction patch pattern 600*a*, the number of patches in the bias-correction patch pattern 600*a*, the size of the intermediate transfer belt B1, the dimensions of patches, etc. The bias correcting unit 402 generates the bias correction data by incorporating, from the density/bias table, target densities selected in a stepwise manner (e.g., 20%, 40%, 60%, etc.) and biases corresponding to the respective target densities.

After generating the bias correction data, the bias correcting unit 402 transmits the generated bias correction data to the image forming unit 404. At the same time, the bias correcting unit 402 notifies the image forming unit 404 that the image forming unit 404 is to idle during the time corresponding to a section (i.e., in FIG. 6A, a section 600S for the first turn of the intermediate transfer belt B1) for obtaining the background densities of the intermediate transfer belt B1 (step S103 of FIG. 5).

Then, the bias correcting unit 402 activates one density sensor (i.e., in FIG. 6A, the density sensor 603 on the left edge in the running direction of the intermediate transfer belt B1) corresponding to the width-direction coordinate value representing positional information in the generated bias correction data. When the leading end of a region 600*b* where background densities are to be obtained reaches the detectable range of the density sensor 603, the bias correcting unit 402 begins to obtain the background densities. The region 600*b* where background densities are to be obtained corresponds to a region where the bias-correction patch pattern 600*a* is to be formed.

For example, the background densities obtained by the bias correcting unit 402 are associated with respective running-direction coordinate values representing positional information in the bias correction data and temporarily stored in a predetermined memory.

When the bias correcting unit 402 starts the bias correction, a test-image-formation control unit 405 detects that the bias correcting unit 402 has begun the bias correction. Then, the test-image-formation control unit 405 instructs a γ-table correcting unit 406 to form a γ-table-correction patch pattern immediately behind the bias-correction patch pattern 600*a* based on the uncorrected biases. The γ-table correcting unit 406 is configured to execute I/O calibration (hereinafter referred to as γ table correction).

The test-image-formation control unit 405 can use any method for instructing the γ-table correcting unit 406 to form a γ-table-correction patch pattern based on the uncorrected biases. For example, the following method may be used.

The test-image-formation control unit 405 activates an environmental-parameter obtaining unit 407 designed to obtain environmental parameters that influence changes in biases. The environmental-parameter obtaining unit 407 obtains environmental parameters used to execute bias estimation (step S104 of FIG. 5).

In the present embodiment, the environmental parameters include the ambient temperature and humidity around the intermediate transfer belt B1, the amount of toner remaining in each of the image forming units FY, FM, FC, and FB, and the operating time of the developing roller 40*a* for each color. The temperature and humidity are obtained, for example, from a temperature/humidity meter located in front near the intermediate transfer belt B1. The amount of remaining toner is obtained, for example, from a remaining-toner detecting unit provided in advance in each of the image forming units FY, FM, FC, and FB. The operating time of the developing roller 40*a* is obtained, for example, from an operating-time storage unit provided in advance in each of the image forming units FY, FM, FC, and FB. These environmental parameters are obtained, for example, through communication between the environmental-parameter obtaining unit 407 and the temperature/humidity meter etc.

After obtaining the environmental parameters, the environmental-parameter obtaining unit 407 transmits the obtained environmental parameters to the test-image-formation control unit 405. Upon receipt of the environmental parameters, the test-image-formation control unit 405 references a variation/environmental-parameter table stored in a bias/environmental-parameter storage unit 408.

The variation/environmental-parameter table associates variations in biases with environmental parameters. The relationships between the variations and the environmental parameters are derived, for example, from past data or theoretical equations by the user (manufacturer). Predetermined operational equations (empirical equations) may be used, as long as they express a correspondence between the variations and the environmental parameters.

The test-image-formation control unit 405 associates environmental parameters in the variation/environmental-parameter table with the respective environmental parameters received from the environmental-parameter obtaining unit 407 to obtain predetermined variations stored in the variation/environmental-parameter table. Next, the test-image-formation control unit 405 refers to the density/bias table stored in the density/bias storage unit 403. The test-image-formation control unit 405 adds the obtained variations to the respective biases (uncorrected biases) in the density/bias table for the respective densities. Then, the test-image-formation control unit 405 uses the resulting values as estimated biases to create a density/estimated-bias table (step S105 of FIG. 5).

Here, the estimated biases correspond to biases that are estimated to result if the bias correcting unit 402 executes bias correction when the environmental parameters are obtained.

The test-image-formation control unit 405 transmits the density/estimated-bias table to the γ-table correcting unit 406. The test-image-formation control unit 405 thus notifies the γ-table correcting unit 406 that a γ-table-correction patch pattern is to be formed immediately behind the bias-correction patch pattern 600*a* based on the density/estimated-bias table. Thus, the accuracy of an execution result obtained from the γ-table-correction patch pattern formed on the basis of the estimated biases can be brought closer to that of an execution result obtained from a bias-correction patch pattern formed on the basis of corrected biases.

Upon receipt of the notification from the test-image-formation control unit 405, the γ-table correcting unit 406 starts γ table correction. The γ table correction can be started, for example, by the following method.

Upon receipt of the notification, the γ-table correcting unit 406 refers to the bias correction data generated by the bias correcting unit 402 to obtain positional information (a coordinate value X1 illustrated in FIG. 6A) for a Patch at the trailing end of the bias-correction patch pattern 600*a* (in the running direction of the intermediate transfer belt B1). To start formation of a γ-table-correction patch pattern 600*c* at a position immediately behind the bias-correction patch pattern 600*a*, the γ-table correcting unit 406 determines positional information (a coordinate value X2 illustrated in FIG. 6A) for a patch at the leading end of the γ-table-correction patch pattern 600*c* (in the running direction of the intermediate transfer belt B1). Next, the γ-table correcting unit 406 refers to a γ table stored in a γ-table storage unit 409 to generate γ-table correction data using the γ table, the positional information for the patch at the leading end, and the density/estimated-bias table received from the test-image-formation control unit 405 (step S106 of FIG. 5).

Here, the γ table is a table that associates input densities (%) of a predetermined color with predetermined output densities (%) used by the image forming unit 404 in image formation. The γ table referred to by the γ-table correcting unit 406 is one that was used by the γ-table correcting unit 406 in the previous execution of γ table correction. In the present embodiment, since the image forming units FY, FM, FC, and FB are provided for the respective colors, different γ tables are provided for the respective colors. A reason to use the γ table in image formation is that the relationship between the input density of each color in image data and the output density (brightness) of an image that is actually seen is not proportional and is, in fact, approximately represented by a curve. The γ tables for the respective colors are to be calibrated, because the image forming unit 404 uses them to ensure that an image actually formed based on the input image data, looks natural.

The γ-table correction data described above is data used by the image forming unit 404 to form the γ-table-correction patch pattern 600*c* illustrated in FIG. 6A. For example, the γ-table correction data includes the following: a predetermined color; predetermined output densities (target output densities) in the γ table for the predetermined color; predetermined estimated biases corresponding to the predetermined color and the predetermined output densities and contained in a density/estimated-bias table; and positional information for patches to be formed on the intermediate transfer belt B1 based on the predetermined color, the predetermined output densities, and the predetermined estimated biases. The positional information is determined in accordance with the type of the γ-table-correction patch pattern 600*c*, the number of patches in the γ-table-correction patch pattern 600*c*, the size of the intermediate transfer belt B1, the dimensions of patches, etc. The positional information for the patch at the leading end of the γ-table-correction patch pattern 600*c* (the coordinate value X2 illustrated in FIG. 6A) is determined by the γ-table correcting unit 406 as described above. The positional information for the other patches is determined by the same method as that for the bias correction data described above, and thus will not be described here.

A width-direction coordinate value representing positional information in the γ-table correction data (a coordinate value Y2 illustrated in FIG. 6A) is set to be different from that representing positional information in the bias correction data (the coordinate value Y1 illustrated in FIG. 6A). In other words, the coordinate value Y2 is set to correspond to the density sensor 604. As illustrated in FIG. 6A, while the bias correcting unit 402 is obtaining background densities from the density sensor 603, the γ-table correcting unit 406 can obtain background densities from the density sensor 604 at the same time. The γ-table correcting unit 406 generates the γ-table correction data by incorporating target output densities selected from the γ table in a stepwise manner.

After generating the γ-table correction data, the γ-table correcting unit 406 transmits the generated γ-table correction data to the image forming unit 404 (step S107 of FIG. 5).

The γ-table correcting unit 406 activates the other density sensor (i.e., in FIG. 6A, the density sensor 604 on the right edge in the running direction of the intermediate transfer belt B1) corresponding to the width-direction coordinate value representing positional information in the generated γ-table correction data. When the leading end of a region 600*d* where background densities are to be obtained reaches the detectable range of the density sensor 604, the γ-table correcting unit 406 starts obtaining the background densities.

As in the case of the bias correcting unit 402, the background densities obtained by the γ-table correcting unit 406 are associated with respective running-direction coordinate values representing positional information in the γ-table correction data and temporarily stored in a predetermined memory. In the present embodiment, the γ-table correcting unit 406 may instruct the image forming unit 404 to form a γ-table-correction patch pattern two consecutive times. Therefore, the γ-table correcting unit 406 obtains background densities twice for two different γ-table-correction patch patterns.

Specifically, after obtaining background densities for a first γ-table-correction patch pattern, the γ-table correcting unit 406 also obtains background densities of a region 600*e* corresponding to a second γ-table-correction patch pattern to be formed immediately behind the first γ-table-correction patch pattern. A distance "d" between the region 600*d* where background densities for the first γ-table-correction patch pattern are to be obtained and the region 600*e* where background densities for the second γ-table-correction patch pattern are to be obtained is used when the γ-table correcting unit 406 generates second γ-table correction data (described below).

Upon receipt of the bias correction data and the γ-table correction data, after idling during the time corresponding to the section 600S for the first turn of the intermediate transfer belt B1, the image forming unit 404 forms the bias-correction patch pattern 600*a* and the γ-table-correction patch pattern 600*c* immediately behind the bias-correction patch pattern 600*a*.

As described, the image forming unit 404 idles during the time corresponding to the section 600S for the first turn of the intermediate transfer belt B1. In coordination with this idling, the bias correcting unit 402 obtains the background densities corresponding to the bias-correction patch pattern, while the γ-table correcting unit 406 obtains the background densities corresponding to the first γ-table-correction patch pattern and the background densities corresponding to the second γ-table-correction patch pattern.

After the bias correcting unit 402 obtains all background densities and when the patch at the leading end of the bias-correction patch pattern 600*a* (in the running direction of the intermediate transfer belt B1) reaches the detectable range of the density sensor 603, the bias correcting unit 402 begins to obtain the densities of patches in the bias-correction patch pattern 600*a*.

For example, when the bias correcting unit 402 obtains a density (measured density) of a predetermined patch, the obtained measured density is associated with a running-direction coordinate value representing positional information for the patch and a background density determined at the running-direction coordinate value, and temporarily stored in the memory described above.

After obtaining the densities (measured densities) of all patches in the bias-correction patch pattern 600*a*, the bias correcting unit 402 executes bias correction based on the background densities and measured densities obtained so far, as well as the target densities and biases in the bias correction data (step S108 of FIG. 5).

Specifically, for each patch, the bias correcting unit 402 subtracts the background density corresponding to the positional information for the patch from the measured density of the patch, and determines the resulting value as an absolute density of the patch. Then, based on the absolute value of the patch, the target density of the patch, and the bias (uncorrected bias) applied to the developing roller 40*a* for forming the patch, the bias correcting unit 402 calculates a bias (corrected bias) that allows the absolute density to agree with the target density. The bias correcting unit 402 thus calculates a bias (corrected bias) for each target density to create a density/corrected-bias table.

After creating the density/corrected-bias table, the bias correcting unit 402 transmits the density/corrected-bias table to a bias determining unit 410. Upon receipt of the density/corrected-bias table, the bias determining unit 410 determines whether corrected biases are within predetermined ranges based on the uncorrected biases (step S109 of FIG. 5).

The determination as to whether the corrected biases are within predetermined ranges can be done by any method. For example, the following method can be used.

Upon receipt of the density/corrected-bias table, the bias determining unit 410 obtains the density/estimated-bias table from the test-image-formation control unit 405. At the same time, the bias determining unit 410 obtains a predetermined threshold value (e.g., 20 V) stored in advance in a predetermined memory. Then, for each density, the bias determining unit 410 defines a predetermined range in which an estimated bias in the density/estimated-bias table is a center value, a value obtained by adding the threshold value to the estimated bias is an upper limit, and a value obtained by subtracting the threshold value from the estimated bias is a lower limit. Next, the bias determining unit 410 checks densities in the density/corrected-bias table against densities in the density/estimated-bias table to compare a corrected bias with a predetermined range for each density. The bias determining unit 410 compares a corrected bias with an upper limit for each density to determine whether the corrected bias is less than the upper limit. If the corrected bias is less than the upper limit, the bias determining unit 410 compares the corrected bias with a lower limit for each density to determine whether the corrected bias is greater than the lower limit. If, for every density, the corrected bias is less than the upper limit and greater than the lower limit, the bias determining unit 410 determines that the corrected biases are within the predetermined ranges (YES in step S109 of FIG. 5). In other cases, such as when a corrected bias is less than the lower limit, the bias determining unit 410 determines that the corrected biases are outside the predetermined ranges (NO in step S109 of FIG. 5).

After completion of the determination, the bias determining unit 410 transmits the determination result to a correction-execution control unit 411. Upon receipt of the determination result, the correction-execution control unit 411 instructs the γ-table correcting unit 406 to perform processing in accordance with the determination result.

That is, if the corrected biases are within the predetermined ranges (e.g., a corrected bias for a predetermined color and a predetermined density is 390 V, and the upper and lower limits of the corresponding predetermined range are 400 V and 360 V, respectively) (YES in step S109 of FIG. 5), since the corrected biases agree with the corresponding estimated biases with a predetermined degree of accuracy, the correction-execution control unit 411 notifies the γ-table correcting unit 406 that the γ table is to be corrected using the γ-table-correction patch pattern 600*c* formed immediately behind the bias-correction patch pattern 600*a*.

After the γ-table correcting unit 406 receives the notification and when the patch at the leading end of the γ-table-correction patch pattern 600*c* reaches the detectable range of the density sensor 604, the γ-table correcting unit 406 begins to obtain the densities of patches in the γ-table-correction patch pattern 600*c*.

For example, when the γ-table correcting unit 406 obtains a density (measured density) of a predetermined patch, the obtained measured density is associated with a running-direction coordinate value representing positional information for the patch and a background density determined at the running-direction coordinate value, and temporarily stored in the memory described above.

After obtaining the measured densities of all patches in the γ-table-correction patch pattern 600*c*, the γ-table correcting unit 406 execute γ table correction based on the background densities and measured densities thus far obtained, as well as the target output densities in the γ-table correction data and the input densities in the γ table (step S110 of FIG. 5).

Specifically, as described above, the γ-table correcting unit 406 calculates an absolute density of each patch based on the measured density and the background density. Then, based on the absolute density of the patch, the target output density of the patch, and the input density corresponding to the target output density of the patch and contained in the γ table, the γ-table correcting unit 406 reconstructs the γ table. The γ-table correcting unit 406 stores the reconstructed γ table in the γ-table storage unit 409. Thus, the γ table correction is completed.

If the corrected biases are outside the predetermined ranges (e.g., a corrected bias for a predetermined color and a predetermined density is 350 V, and the upper and lower limits of the corresponding predetermined range are 400 V and 360 V, respectively) (NO in step S109 of FIG. 5), the corrected biases and the corresponding estimated biases are significantly different from each other. Therefore, the correction-execution control unit 411 transmits the density/corrected-bias table to the γ-table correcting unit 406, and notifies the γ-table correcting unit 406 that another γ-table-correction patch pattern is to be formed based on the corrected biases in the density/corrected-bias table.

Figure 6B:
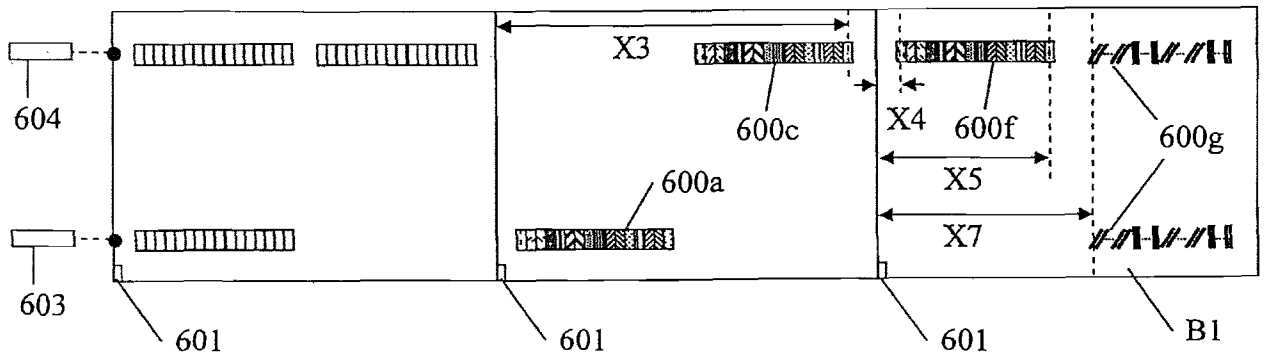
FIG. 6B schematically illustrates patch patterns used when corrected biases are outside predetermined ranges in a series of calibrations in an embodiment of the present disclosure.

FIG. 6B schematically illustrates patch patterns used when corrected biases are outside predetermined ranges.

Upon receipt of the notification from the correction-execution control unit 411, the γ-table correcting unit 406 refers to the existing γ-table correction data to obtain positional information (a coordinate value X3 illustrated in FIG. 6B) for a patch at the trailing end of the γ-table-correction patch pattern 600*c* (in the running direction of the intermediate transfer belt B1). By using this positional information and the distance "d" between the region 600*d* and the region 600*e* described above, the γ-table correcting unit 406 determines positional information (a coordinate value X4 illustrated in FIG. 6B) for a patch at the leading end of the second γ-table-correction patch pattern or a γ-table-correction patch pattern 600*f*. This starts the formation of the γ-table-correction patch pattern 600*f* (corresponding to a second parameter-correction image) immediately behind the γ-table-correction patch pattern 600*c* (corresponding to a first parameter-correction image) and, at the same time, allows execution of γ table correction using the background densities obtained in the region 600*e*. Next, the γ-table correcting unit 406 generates γ-table correction data again using the positional information for the patch at the leading end of the γ-table-correction patch pattern 600*f*, the density/corrected-bias table received from the correction-execution control unit 411, and the γ table (step S111 of FIG. 5). The generation of γ-table correction data will not be described here, as it is the same as that described above.

After again generating γ-table correction data, the γ-table correcting unit 406 transmits the γ-table correction data to the image forming unit 404 (step S112 of FIG. 5). Upon receipt of the γ-table correction data, the image forming unit 404 forms the γ-table-correction patch pattern 600*f* (second patch pattern) based on the density/corrected-bias table immediately behind the γ-table-correction patch pattern 600*c* (first patch pattern) based on the density/estimated-bias table.

After the γ-table correcting unit 406 transmits the γ-table correction data and when the patch at the leading end of the γ-table-correction patch pattern 600*f* (in the running direction of the intermediate transfer belt B1) reaches the detectable range of the density sensor 604, the γ-table correcting unit 406 starts obtaining the densities of patches in the γ-table-correction patch pattern 600*f*.

For example, when the γ-table correcting unit 406 obtains a density (measured density) of a predetermined patch, the obtained measured density is associated with a running-direction coordinate value representing positional information for the patch and a background density determined at the running-direction coordinate value, and temporarily stored in the memory described above.

After obtaining the measured densities of all patches in the γ-table-correction patch pattern 600*f*, the γ-table correcting unit 406 execute γ table correction in the same manner as that described above (step S113 of FIG. 5). That is, the γ-table correcting unit 406 reconstructs (corrects) the γ table based on the background densities, measured densities, target output densities, and input densities in the γ table, and stores the reconstructed γ table in the γ-table storage unit 409. Thus, although the process involves formation of two γ-table-correction patch patterns, since γ table correction is executed based on the γ-table-correction patch pattern 600*f* using corrected biases, the accuracy of the result of the execution is ensured.

After completion of the γ table correction, the correction-execution control unit 411 notifies the bias correcting unit 402 of the completion. Upon receipt of the notification, the bias correcting unit 402 changes (updates) the density/bias table (density/uncorrected-bias table) stored in the density/bias storage unit 403 to the density/corrected-bias table (step S114 of FIG. 5). Thus, the bias correction is completed. This updating operation may be performed when the bias correcting unit 402 generates the density/corrected-bias table.

Registration correction is performed, for example, by the following procedure.

Upon completion of the bias correction, the correction-execution control unit 411 notifies a registration correcting unit 412 designed to execute registration calibration (hereinafter referred to as registration correction) that registration correction is to be performed (step S115 of FIG. 5).

Upon receipt of the notification, the registration correcting unit 412 refers to the latest γ-table correction data (first γ-table correction data or second γ-table correction data) most recently generated by the γ-table correcting unit 406, and obtains the positional information (the coordinate value X3 illustrated in FIG. 6A or the coordinate value X5 illustrated in FIG. 6B) for the patch at the trailing end of the γ-table-correction patch pattern 600*c* or 600*f* (in the running direction of the intermediate transfer belt B1). To start formation of a registration-correction patch pattern 600*g* at a position immediately behind the γ-table-correction patch pattern 600*c* or 600*f*, the registration correcting unit 412 determines positional information (a coordinate value X6 illustrated in FIG. 6A or a coordinate value X7 illustrated in FIG. 6B) for patches at the leading end of the registration-correction patch pattern 600*g*. Then, the registration correcting unit 412 generates registration correction data using the positional information for the patches at the leading end of the registration-correction patch pattern 600*g*, the density/corrected-bias table, and a positional parameter stored in a positional-parameter storage unit 413.

Here, the positional parameter is a parameter that defines a position at which the image forming unit 404 forms a toner image on the intermediate transfer belt B1 based on the image data. The positional parameter used (referred to) by the registration correcting unit 412 is one that was used by the registration correcting unit 412 in the previous execution of registration correction. In the present embodiment, since the image forming units FY, FM, FC, and FB are provided for the respective colors, different positional parameters are provided for the respective colors. The positional parameters for the respective colors are to be calibrated, because the image forming unit 404 uses them to form an image based on the input image data.

The registration correction data described above is data for forming the registration-correction patch pattern 600*g* on the intermediate transfer belt B1 as illustrated in FIG. 6A and FIG. 6B. For example, the registration correction data includes the following: a predetermined color; predetermined densities; predetermined biases corresponding to the predetermined color and the predetermined densities and contained in the density/corrected-bias table; positional information for patches to be formed on the intermediate transfer belt B1 based on the predetermined color, the predetermined densities, and the predetermined biases; and shape information (target shape information) for the patches determined by the positional information. The positional information is determined in accordance with the type of the registration-correction patch pattern 600*g*, the number of patches in the registration-correction patch pattern 600*g*, the size of the intermediate transfer belt B1, the dimensions of patches, etc. The positional information (the coordinate value X6 illustrated in FIG. 6A or the coordinate value X7 illustrated in FIG. 6B) for patches at the leading end of the registration-correction patch pattern 600*g* is one determined by the registration correcting unit 412 as described above. The positional information for the other patches is determined by the same method as that for the bias correction data described above, and thus will not be described here. Examples of patch shapes defined by the shape information include a rectangle perpendicular to the running direction of the intermediate transfer belt B1 and a rectangle inclined a predetermined angle (e.g., 45 degrees) from the running direction of the intermediate transfer belt B1. The registration-correction patch pattern 600*g* is formed such that two identical patches are simultaneously detected by the density sensors 603 and 604.

After generating the registration correction data, the registration correcting unit 412 transmits the registration correction data to the image forming unit 404. Upon receipt of the registration correction data, the image forming unit 404 forms the registration-correction patch pattern 600*g* immediately behind the γ-table-correction patch pattern 600*c* or 600*f*.

After the registration correcting unit 412 transmits the registration correction data and when the two patches at the leading end of the registration-correction patch pattern 600*g* reach the respective detectable ranges of the density sensors 603 and 604, the registration correcting unit 412 starts obtaining shape information (measured shape information) for patches in the registration-correction patch pattern 600*g*. The measured shape information corresponds to information (e.g., coordinate values and angles) determined by the detected levels of the measured densities.

When the registration correcting unit 412 obtains information on the measured shape for a predetermined patch, the information is associated with a running-direction coordinate value representing the position of the patch and temporarily stores the information in a predetermined memory.

After obtaining measured shape information for all patches in the registration-correction patch pattern 600*g*, the registration correcting unit 412 corrects the positional parameter based on the measured shape information for the patches, target positional information, and positional information in the registration correction data. Then, the registration correcting unit 412 stores the corrected positional parameter in the positional-parameter storage unit 413. Thus, the registration correction is completed.

When the registration correcting unit 412 completes the registration correction, the execution of the series of calibrations is complete. This allows the image forming unit 404 to execute image formation based on the predetermined image data.

A description will now be given of functions and effects of a multifunction peripheral according to the present embodiment.

Figure 7A:
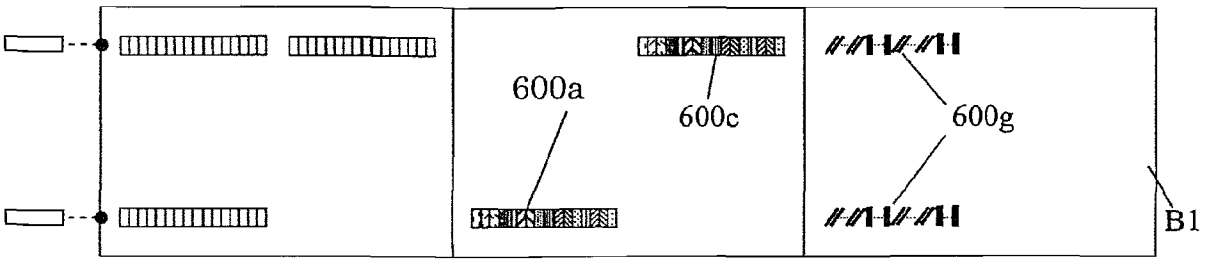
FIG. 7A schematically illustrates patch patterns used when corrected biases are within predetermined ranges in a series of calibrations in an embodiment of the present disclosure.
Figure 7B:
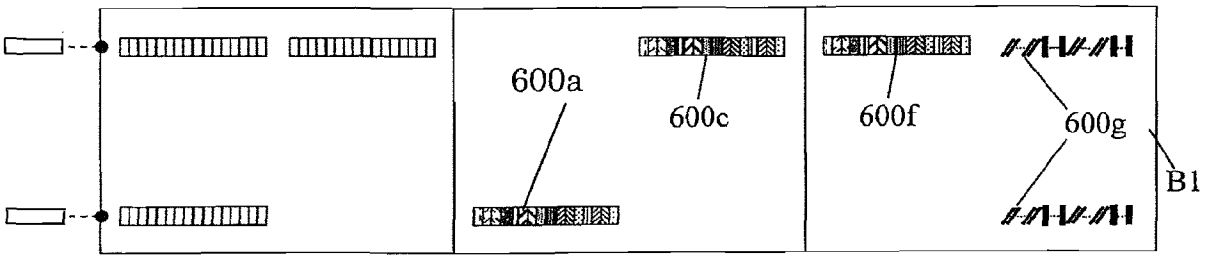
FIG. 7B schematically illustrates patch patterns used when corrected biases are outside predetermined ranges in a series of calibrations in an embodiment of the present disclosure.
Figure 7C:
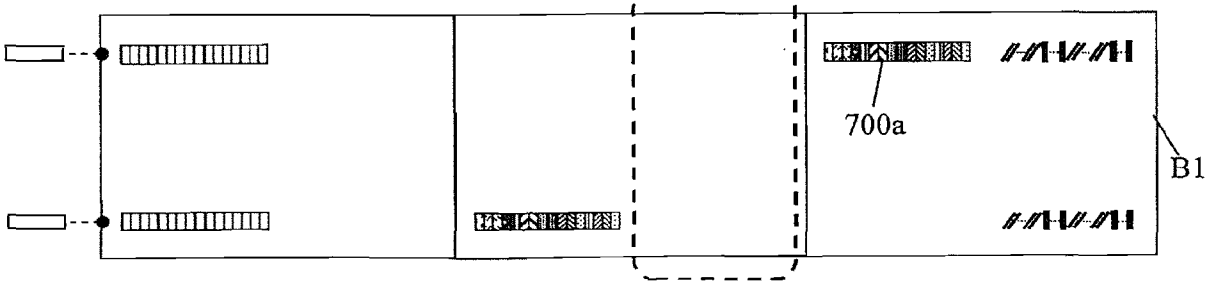
FIG.7C Prior Art
FIG. 7C schematically illustrates patch patterns used in a series of calibrations in the prior art.
Figure 8:
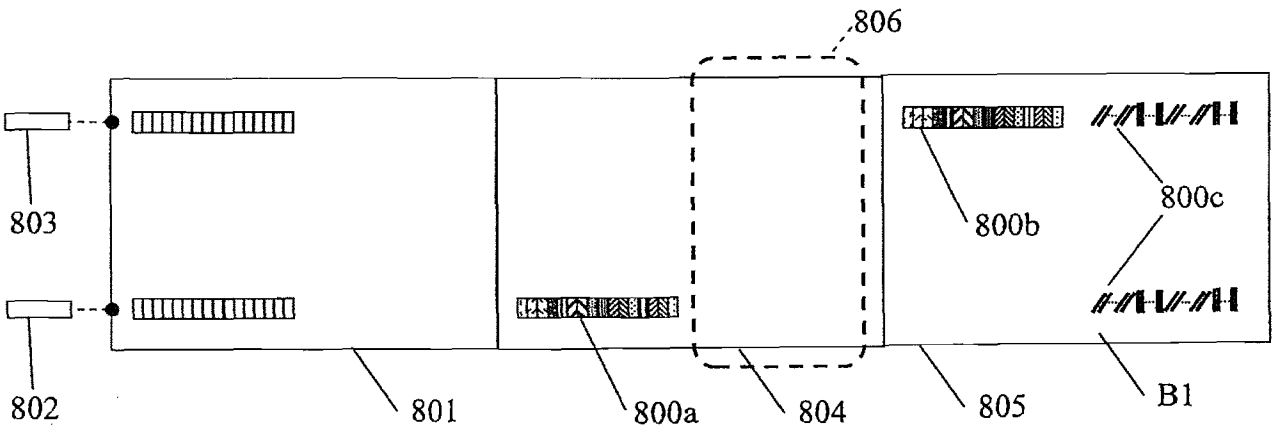
FIG. 8 schematically illustrates patch patterns used in a series of calibrations in the prior art.

FIG. 7A schematically illustrates patch patterns used when corrected biases are within predetermined ranges in a series of calibrations according to the present embodiment. FIG. 7B schematically illustrates patch patterns used when corrected biases are outside predetermined ranges. FIG. 7C schematically illustrates patch patterns in a series of calibrations according to the related art. FIG. 7A to FIG. 7C each illustrate an area that is divided by solid lines into three sections, each corresponding to one turn of the intermediate transfer belt B1.

The dimensions of patch patterns in the present embodiment are set to be the same as those in the prior art.

In the series of calibrations in the present embodiment, if corrected biases are within predetermined ranges, the γ-table-correction patch pattern 600*c* based on estimated biases is formed immediately behind the bias-correction patch pattern 600*a* as illustrated in FIG. 7A. Therefore, in the area of the intermediate transfer belt B1 where three types of patch patterns are formed, there is no empty space (such as a space 700 in FIG. 7C) where no patch pattern is formed. Thus, execution of the series of calibrations requires only an area corresponding to two and a half turns of the intermediate transfer belt B1. This means that the time required for the series of calibrations in the present embodiment is shorter than that for the series of calibrations in the prior art by the amount of time that is required for movement of the space that corresponds to half a turn of the intermediate transfer belt B1.

On the other hand, if corrected biases are outside predetermined ranges, the γ-table-correction patch pattern 600*f* based on the corrected biases is formed immediately behind the γ-table-correction patch pattern 600*c* based on estimated biases as illustrated in FIG. 7B. In this situation, although the γ-table-correction patch pattern 600*c* becomes useless, the time when formation of the γ-table-correction patch pattern 600*f* takes place is substantially the same as that when formation of a γ-table-correction patch pattern 700*a* based on corrected biases in the prior art (see FIG. 7C) takes place. Therefore, as in the case of the prior art, execution of the series of calibrations in the present embodiment requires three sections of the intermediate transfer belt B1 corresponding to respective three turns of the intermediate transfer belt B1. That is, the time required for the series of calibrations in the present embodiment is substantially the same as, and not longer than, that required for the series of calibrations in the related art illustrated in FIG. 7C.

As described above, the image forming apparatus 1 according to the present embodiment includes the photosensitive drum 10, the intermediate transfer belt B1, the test-image-formation control unit 405, the bias correcting unit 402, the bias determining unit 410, and the γ-table correcting unit 406. The photosensitive drum 10 bears an image. The intermediate transfer belt B1 is a member to which the image is transferred from the photosensitive drum 10. The test-image-formation control unit 405 insures that, on the intermediate transfer belt B1, the bias-correction patch pattern 600*a* is formed based on the uncorrected biases and the γ-table-correction patch pattern 600*c* is formed immediately behind the bias-correction patch pattern 600*a* based on the uncorrected biases and an uncorrected γ table. The bias correcting unit 402 obtains corrected biases by correcting uncorrected biases based on the bias-correction patch pattern 600*a*. The bias determining unit 410 determines whether corrected biases are within predetermined ranges defined on the basis of uncorrected biases. The γ-table correcting unit 406 corrects, if corrected biases are within predetermined ranges, an uncorrected γ table based on the γ-table-correction patch pattern 600*c* and thus obtains a corrected γ table.

As described above, before completion of bias correction, that is, at a stage before biases are corrected, the γ-table-correction patch pattern 600*c* based on uncorrected biases is formed immediately behind the bias-correction patch pattern 600*a* on the intermediate transfer belt B1. This makes it possible to eliminate the empty space 700 that is created on the intermediate transfer belt B1 in the prior art and reduce the time required for calibration. If corrected biases are within predetermined ranges defined on the basis of uncorrected biases, even when the calibration is performed using the γ-table-correction patch pattern 600*c* already formed, the accuracy of the result of execution is not reduced.

If corrected biases are outside predetermined ranges, the test-image-formation control unit 405 insures that the γ-table-correction patch pattern 600*f* based on corrected biases and an uncorrected γ table is formed after the γ-table-correction patch pattern 600*c*. Then, the γ-table correcting unit 406 obtains a corrected γ table by correcting the uncorrected γ table based on the γ-table-correction patch pattern 600*f*.

Thus, when corrected biases are outside predetermined ranges, in other words, when corrected biases are significantly different from uncorrected biases, a γ-table-correction patch pattern is again formed using the corrected biases. However, the time when formation of this γ-table-correction patch pattern takes place is substantially the same as that when formation of a γ-table-correction patch pattern takes place in the prior art. Therefore, the time required for the entire calibration process in the present embodiment is substantially the same as, and not longer than, that required for the entire calibration process in the prior art. It is thus possible to reduce the time required for the entire calibration process without reducing the accuracy of the result of execution of the γ table correction.

Although a predetermined variation/environmental-parameter table is stored in the bias/environmental-parameter storage unit 408 in the present embodiment, a different configuration may be used. For example, when the bias correcting unit 402 executes bias correction, the environmental-parameter obtaining unit 407 may detect the execution of bias correction, obtain environmental parameters and corrected biases at the time of the execution of bias correction, and add the environmental parameters and the corrected biases to the variation/environmental-parameter table as past data (i.e., reconstruct or update the variation/environmental-parameter table using the obtained environmental parameters and corrected biases). The relationship between environmental parameters and biases varies depending on, for example, the type and size of the image forming apparatus. Therefore, if environmental parameters and corrected biases are stored as necessary in response to execution of bias correction, the accuracy of estimated biases obtained by the test-image-formation control unit 405 can be improved and the time required for the entire calibration process can be reliably reduced. Also, in the present embodiment, a variation/environmental-parameter table based on variations in biases is stored in the bias/environmental-parameter storage unit 408. However, as long as it is possible to estimate biases from past data and environmental parameters, the functions and effects of the present embodiment can be achieved even when the variation/environmental-parameter table is replaced with a bias/environmental-parameter table that associates biases with environmental parameters.

In the present embodiment, when the bias correcting unit 402 starts a bias correction, the test-image-formation control unit 405 detects the start of bias correction and instructs the γ-table correcting unit 406 to form the γ-table-correction patch pattern 600*c* immediately behind the bias-correction patch pattern 600*a* based on the uncorrected biases. However, a different configuration may be used. For example, as long as it is possible to have the γ-table correcting unit 406 form the γ-table-correction patch pattern 600*c* immediately behind the bias-correction patch pattern 600*a* based on the uncorrected biases, the test-image-formation control unit 405 may instruct the γ-table correcting unit 406 upon detecting the start time of formation of the bias-correction patch pattern 600*a*, the end time of formation of the bias-correction patch pattern 600*a*, or generation of bias correction data by the bias correcting unit 402.

In the present embodiment, the calibration-start detecting unit 401 is configured to detect the power-on time of the image forming apparatus 1 as a calibration start time. However, the calibration start time may be a different time, such as the time when the color printing of 80 to 250 sheets is completed.

In the present embodiment, the image forming apparatus 1 is configured to include the components illustrated in FIG. 4. However, the image forming apparatus 1 may be provided with a storage medium in which a program for achieving these components is stored. With this design, the image forming apparatus 1 reads the program to achieve these components. In this case, the program read from the storage medium has the functions and effects of the present embodiment. A storage method may be provided in which steps to be executed by these components are stored on a hard disk.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. An image forming apparatus comprising:

an image bearing member configured to bear an image;

a transfer member to which the image can be transferred from the image bearing member;

a correction-image-formation control unit configured such that, on the transfer member, a bias correction image is formed based on an uncorrected bias and a first parameter-correction image is formed behind the bias correction image based on the uncorrected bias and an uncorrected image-formation parameter with no intervening correction image;

a bias correcting unit configured to obtain a corrected bias by correcting the uncorrected bias based on the bias correction image;

a bias determining unit configured to determine whether the corrected bias is within a predetermined range defined based on the uncorrected bias;

a parameter correcting unit configured to obtain, if the corrected bias is within the predetermined range, a corrected image-formation parameter by correcting the uncorrected image-formation parameter based on the first parameter-correction image; and wherein if the corrected bias is outside the predetermined range, the correction-image-formation control unit causes a second parameter-correction image to be formed after the first parameter-correction image based on the corrected bias and the uncorrected image-formation parameter, and the parameter correcting unit obtains a corrected image-formation parameter by correcting the uncorrected image-formation parameter based on the second parameter-correction image.

2. The image forming apparatus according to claim 1, comprising:

an environmental-parameter obtaining unit configured to obtain an environmental parameter related to an environment around the transfer member;

a storage unit configured to store a table that associates the environmental parameter with a variation in the bias; and wherein the correction-image-formation control unit causes the first parameter-correction image to be formed based on the environmental parameter obtained by the environmental-parameter obtaining unit and the variation corresponding to the obtained environmental parameter.

3. The image forming apparatus according to claim 2, wherein the storage unit updates the table based on the corrected bias.

4. The image forming apparatus according to claim 2, wherein the storage unit stores the temperature around the transfer member as the environmental parameter.

5. The image forming apparatus according to claim 2, wherein the storage unit stores the humidity around the transfer member as the environmental parameter.

6. The image forming apparatus according to claim 1, wherein the image-formation parameter is a .gamma. table.

7. A method for forming an image comprising:

causing a bias correction image to be formed on a transfer member to which an image is transferred from an image bearing member bearing the image based on an uncorrected bias and a first parameter-correction image to be formed behind the bias correction image based on the uncorrected bias and an uncorrected image-formation parameter with no intervening correction image;

obtaining a corrected bias by correcting the uncorrected bias using the bias correction image;

determining whether the corrected bias is within a predetermined range defined based on the uncorrected bias;

obtaining, if the corrected bias is within the predetermined range, a corrected image-formation parameter by correcting the uncorrected image-formation parameter using the first parameter-correction image; and wherein if the corrected bias is outside the predetermined range, a second parameter-correction image is formed after the first parameter-correction image based on the corrected bias and the uncorrected image-formation parameter, and a corrected image-formation parameter is obtained by correcting the uncorrected image-formation parameter based on the second parameter-correction image.

8. A non-transitory computer-readable recording medium recording a program for having a computer function as:

a correction-image-formation control unit configured so as to cause, on a transfer member to which an image is transferred from an image bearing member bearing the image, a bias correction image to be formed based on an uncorrected bias and a first parameter-correction image to be formed behind the bias correction image based on the uncorrected bias and an uncorrected image-formation parameter with no intervening correction image;

a bias correcting unit configured to obtain a corrected bias by correcting the uncorrected bias based on the bias correction image;

a bias determining unit configured to determine whether the corrected bias is within a predetermined range defined based on the uncorrected bias;

a parameter correcting unit configured to obtain, if the corrected bias is within the predetermined range, a corrected image-formation parameter by correcting the uncorrected image-formation parameter based on the first parameter-correction image; and wherein if the corrected bias is outside the predetermined range, the correction-image-formation control unit causes a second parameter-correction image to be formed after the first parameter-correction image based on the corrected bias and the uncorrected image-formation parameter, and the parameter correcting unit obtains a corrected image-formation parameter by correcting the uncorrected image-formation parameter based on the second parameter-correction image.

* * * * *